US005549204A

United States Patent [19]

Toren

[11] Patent Number: 5,549,204

[45] Date of Patent: Aug. 27, 1996

[54] BLISTER PACKS

[75] Inventor: Thomas Toren, Bondi Junction, Australia

[73] Assignee: Toren Consulting Pty. Ltd., Bondi Junction, Australia

[21] Appl. No.: 585,600

[22] Filed: Jan. 11, 1996

Related U.S. Application Data

[63] Continuation of Ser. No. 290,789, filed as PCT/AU93/00063, Feb. 12, 1993, published as WO93/16673, Sep. 2, 1993.

[51] Int. Cl.[6] ..... B65D 83/04

[52] U.S. Cl. ..... 206/539; 206/531; 206/470; 206/469; 220/4.23

[58] Field of Search ..... 206/531, 532, 206/534.1, 534.2, 538, 539, 461, 463, 467, 470, 471, 472, 469; 220/4.22, 4.23, 4.24, 520

[56] References Cited

U.S. PATENT DOCUMENTS

| | | | |
|---|---|---|---|
| 2,309,111 | 1/1943 | Hothersall | 206/534.1 |
| 2,319,560 | 5/1943 | Salfisberg | 206/474 |
| 2,845,104 | 7/1958 | Frankel | 220/4.23 |
| 3,689,458 | 9/1972 | Hellstrom | 206/532 |
| 4,165,709 | 8/1970 | Studer | 206/531 X |
| 4,512,474 | 4/1985 | Harding | 206/461 |
| 4,739,883 | 4/1988 | Mohs et al. | 206/470 |
| 4,872,559 | 10/1989 | Schoon | 206/538 |
| 4,911,304 | 3/1990 | Bunin . | |
| 5,052,615 | 10/1991 | Ott et al. | 229/931 X |
| 5,074,416 | 12/1991 | Hustand | 206/524.8 |
| 5,129,527 | 7/1992 | Lataix | 206/539 |
| 5,150,793 | 9/1992 | Tannenbaum | 206/531 |
| 5,293,993 | 3/1994 | Yates, Jr. et al. | 206/365 |

FOREIGN PATENT DOCUMENTS

| | | |
|---|---|---|
| 4014811 | 11/1991 | Germany . |
| 4101265 | 7/1992 | Germany . |
| 757642 | 9/1956 | United Kingdom . |

*Primary Examiner*—Paul T. Sewell
*Assistant Examiner*—Tara L. Laster
*Attorney, Agent, or Firm*—Christie, Parker & Hale, LLP

[57] ABSTRACT

A blister pack for tablets or capsules having a flexible plastic sheet (1) thermoformed to define a plurality of open faced pockets (2) each pocket being shaped to receive an individual tablet or capsule, the open faces of the pockets being closed by a sheet of aluminum foil heat sealed to the plastic sheet, characterized in that hinge means (5) are provided across the pack on a line about which the pack is substantially symmetrical, the two halves of the pack on either side of the hinge being adapted to be folded together with the area of aluminum foil of each said halves overlying the other whereby the aluminum foil is protected from accidental damage that might be caused by contact with a hard object, resealable fastening means (6,7) being provided to maintain the pack in a folded configuration.

7 Claims, 9 Drawing Sheets

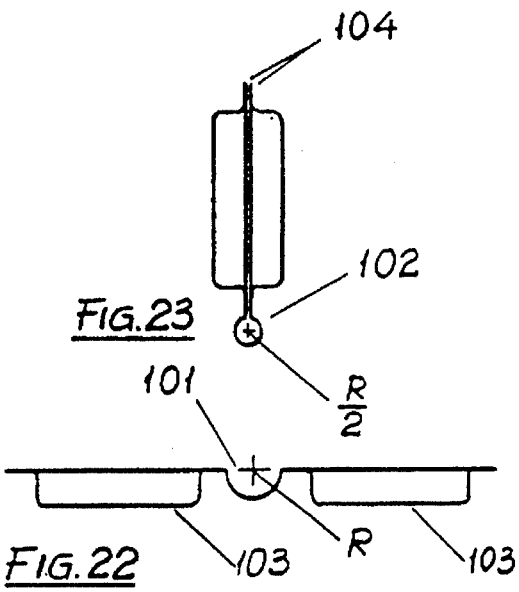
FIG. 23
FIG. 22
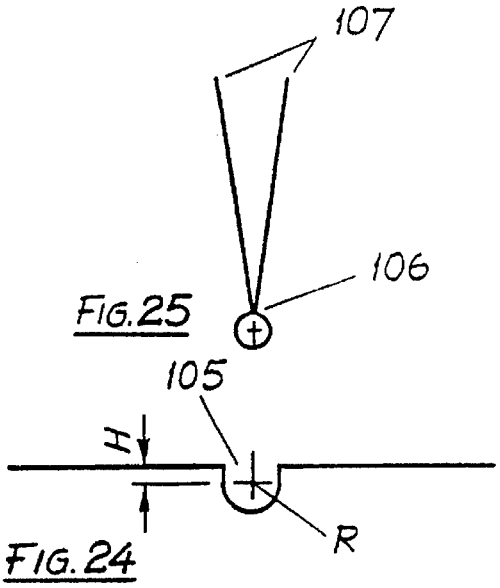
FIG. 25
FIG. 24
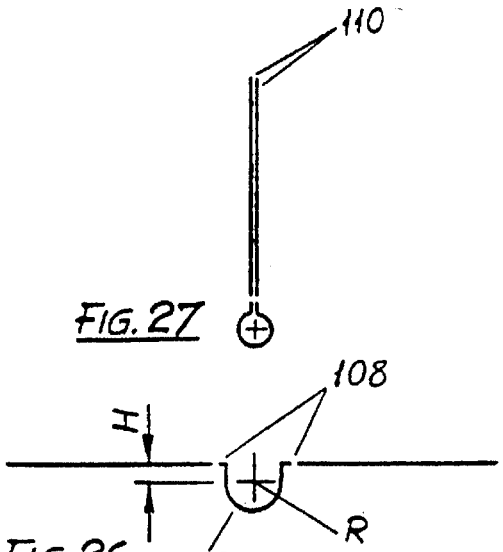
FIG. 27
FIG. 26
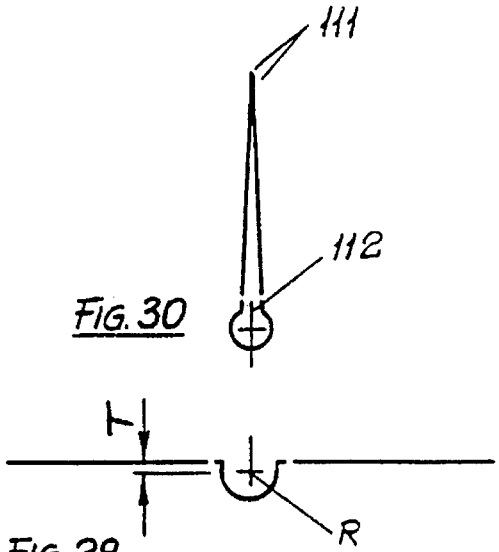
FIG. 30
FIG. 29
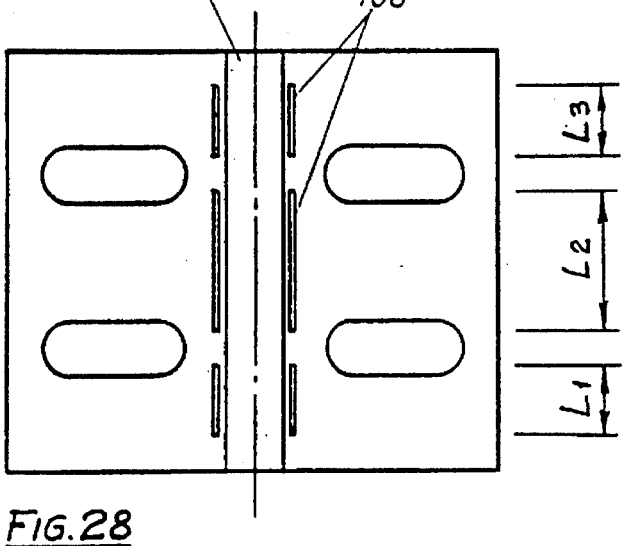
FIG. 28

BLISTER PACKS

CROSS-REFERENCE TO RELATED APPLICATION

This is a continuation of application Ser. No. 08/290,789, filed as PCT/AU93/00063 on Feb. 12, 1993, published as WO93/16673 on Sep. 9, 1993.

Blister packs are now widely used for medicinal and food supplement tablets and capsules, whereby these tablets or capsules are contained between a normally transparent, flexible plastic sheet, thermoformed so as to define a plurality of pockets, with each pocket being just large enough to receive the shape of the individual tablet or capsule, and a flat aluminium foil, heat sealed to said plastic sheet.

The main advantage of this type of packaging is the extended shelf life, due to protection against oxygen and humidity, that it provides for these medicinal tablets and capsules, compared to conventional packaging in bottles and containers. With blister packaging, the tablet or capsule does not get exposed to external air and humidity until such time that the aluminium foil is broken. The aluminium foil is not supposed to be broken until just prior to the user ingesting the tablet or capsule.

In the case of conventional bottles and containers, all of the tablets or capsules inside that bottle or container are exposed to external air and humidity every time that the cap is taken off in order to take out just one of these tablets or capsules.

The second advantage of blister packs is the convenience to the user of being able to carry around in his or her pocket or handbag just one flat and light blister card of tablets instead of having to carry the whole bulky and heavy bottle. The need to carry tablets on one's person applies to many tablets, such as headache, anti-histamine, contraceptive, antacid, anti-inflammatory and heart tablets etc.

The object of this invention is to prevent the blister packs of tablets, pills and capsules from being accidentally damaged when individual blister cards are being carried around in pockets, handbags, briefcases, glove compartments etc. Such damage occurs frequently with the present form of blister cards, when other hard objects such as keys, coins, lipstick, pen, comb, spectacles etc., come into contact with the individual blister card, punctures the frangible aluminium foil and thereby exposes the tablet or capsule to the external air, humidity and other contaminants.

The present invention consists in a blister pack for tablets or capsules comprising a flexible plastic sheet, thermoformed to define a plurality of open faced pockets each pocket being shaped to receive an individual tablet or capsule, the open faces of the pockets being closed by a sheet of aluminium foil, heat sealed to the plastic sheet, characterised in that hinge means are provided across the pack on a line about which the pack is substantially symmetrical, the two halves of the pack on either side of the hinge being adapted to be folded together with the area of aluminium foil of each said halves overlying the other, whereby the aluminium foil is protected from accidental damage that might be caused by contact with a hard object, resealable fastening means being provided to maintain the pack in a folded configuration. It is preferred that the fastening means be formed integrally with the pack, separate fastening means may however be provided.

It is preferred that the hinge means consists in a hinge groove formed by thermoforming and having cuts extending parallel to the groove on either side thereof, the depth of the groove and the lengths of the cuts being selected in relation to the characteristics of the sheet so that when the sheet is folded about the hinge, parts thereof on either side of the hinge will each fold through 90° to lie flat against and in contact with the other part.

Without restricting the full scope of this invention, several preferred forms of this invention are illustrated in the following drawings.

FIG. **19*a*** is a plan view of a blister card with a thermoformed hinge, two key and groove fastening means, two pairs of opening tabs and four rows of blisters for tablets, each row holding seven tablets, one tablet for each day of the week.

Figures 19A, 19B, 19C, 19D:
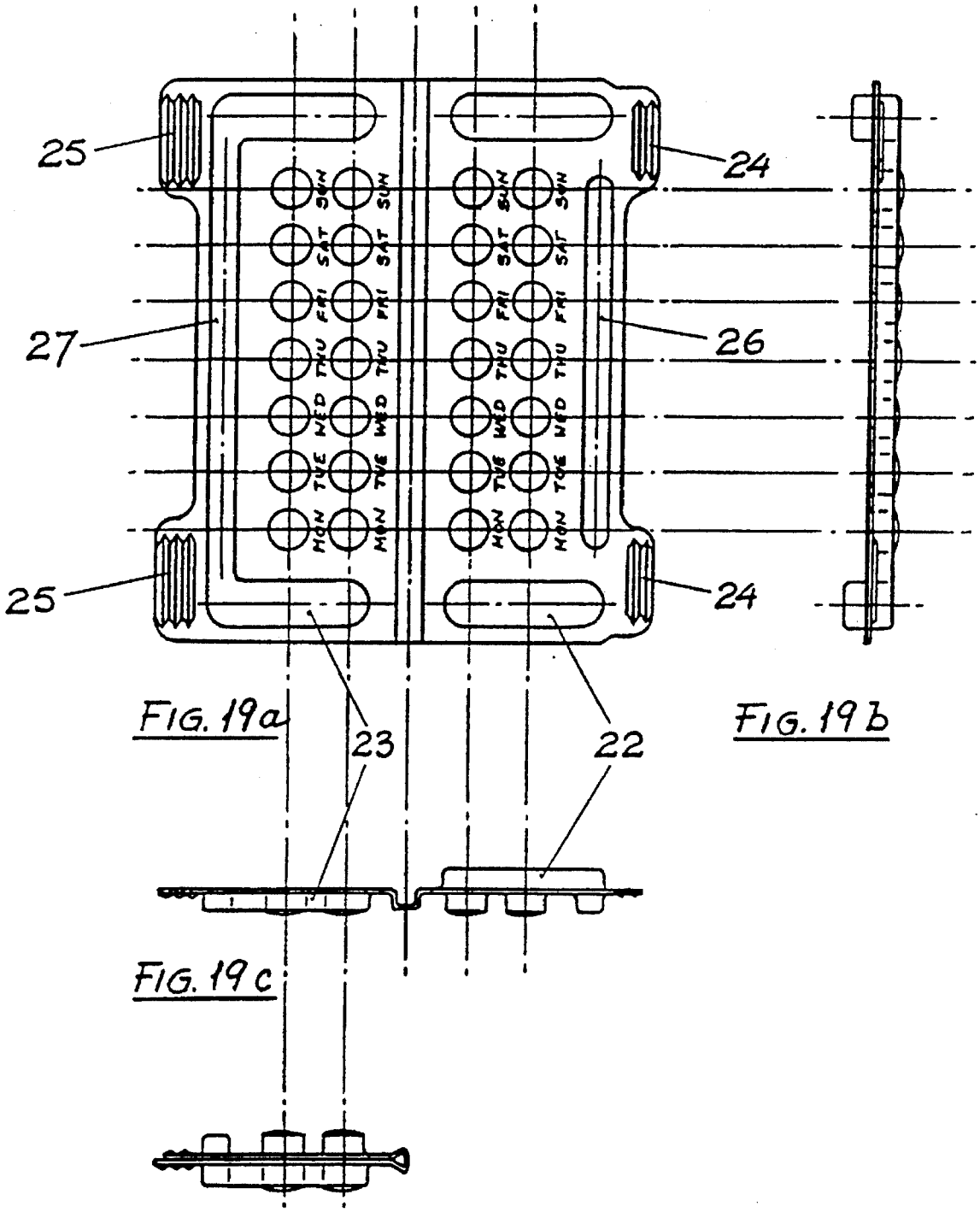

FIG. **19*b* is an end elevational view of the blister card of FIG. 19*a***.

FIG. **19*c* is a side elevational view of the blister card of FIG. 19*a*** before being folded.

FIG. **19*d* is a side elevational view of the blister card of FIG. 19*a*** after being folded.

FIG. **20*a*** is a plan view of a blister card with tongue and cut-out fastening means.

Figures 20A, 20B, 20C, 20D, 20E:
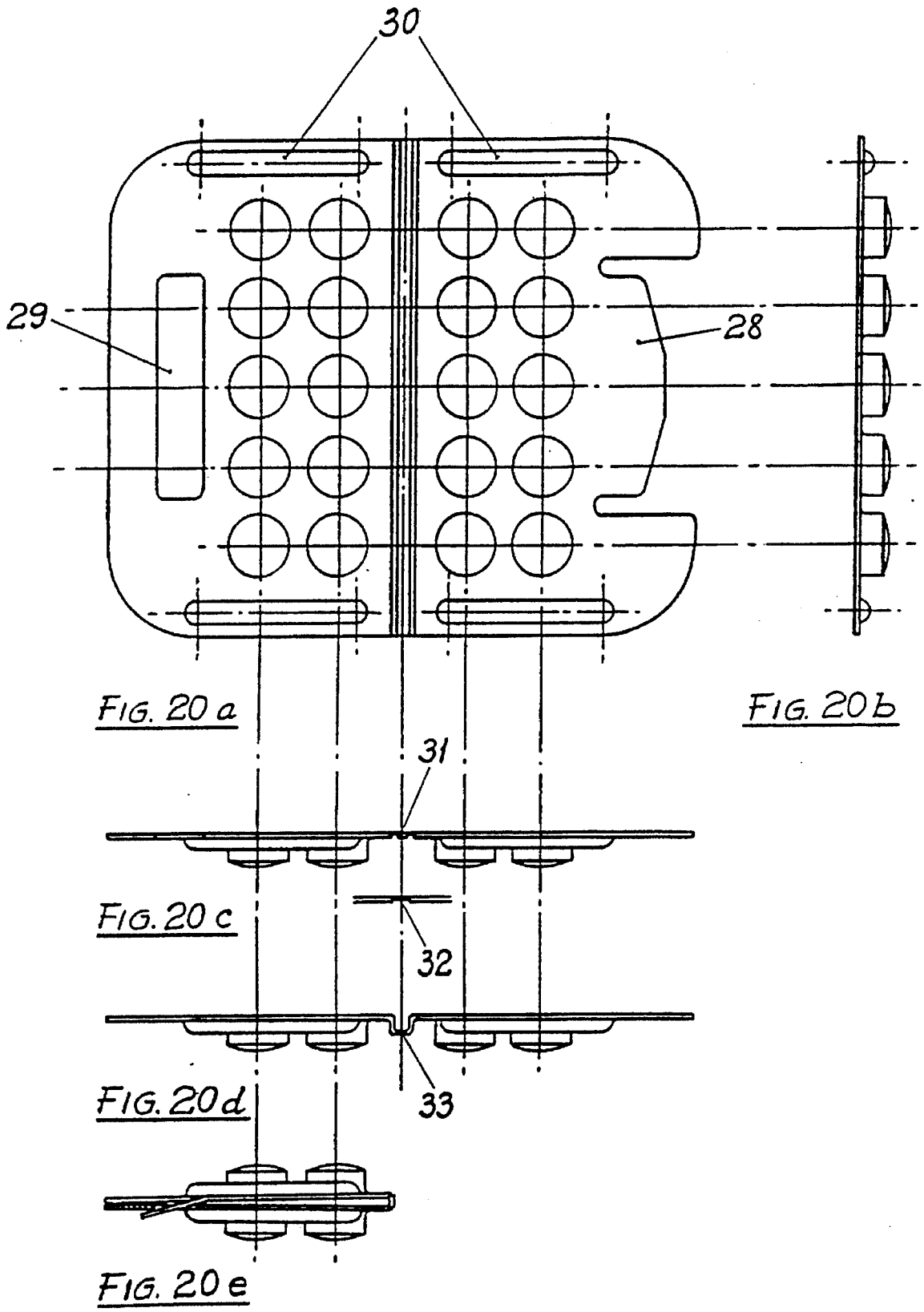

FIG. **20*b* is an end elevational view of the blister card of FIG. 20*a***.

FIG. 20*c* is a side elevational view of the blister card of FIG. 20*a* with creased hinge before being folded.

FIG. 20*d* is a side elevational view of the blister card of FIG. 20*a* with thermoformed hinge before being folded.

FIG. 20*e* is a side elevational view of the blister card of FIG. 20*a* after being folded.

Figures 21A, 21B, 21C, 21D:
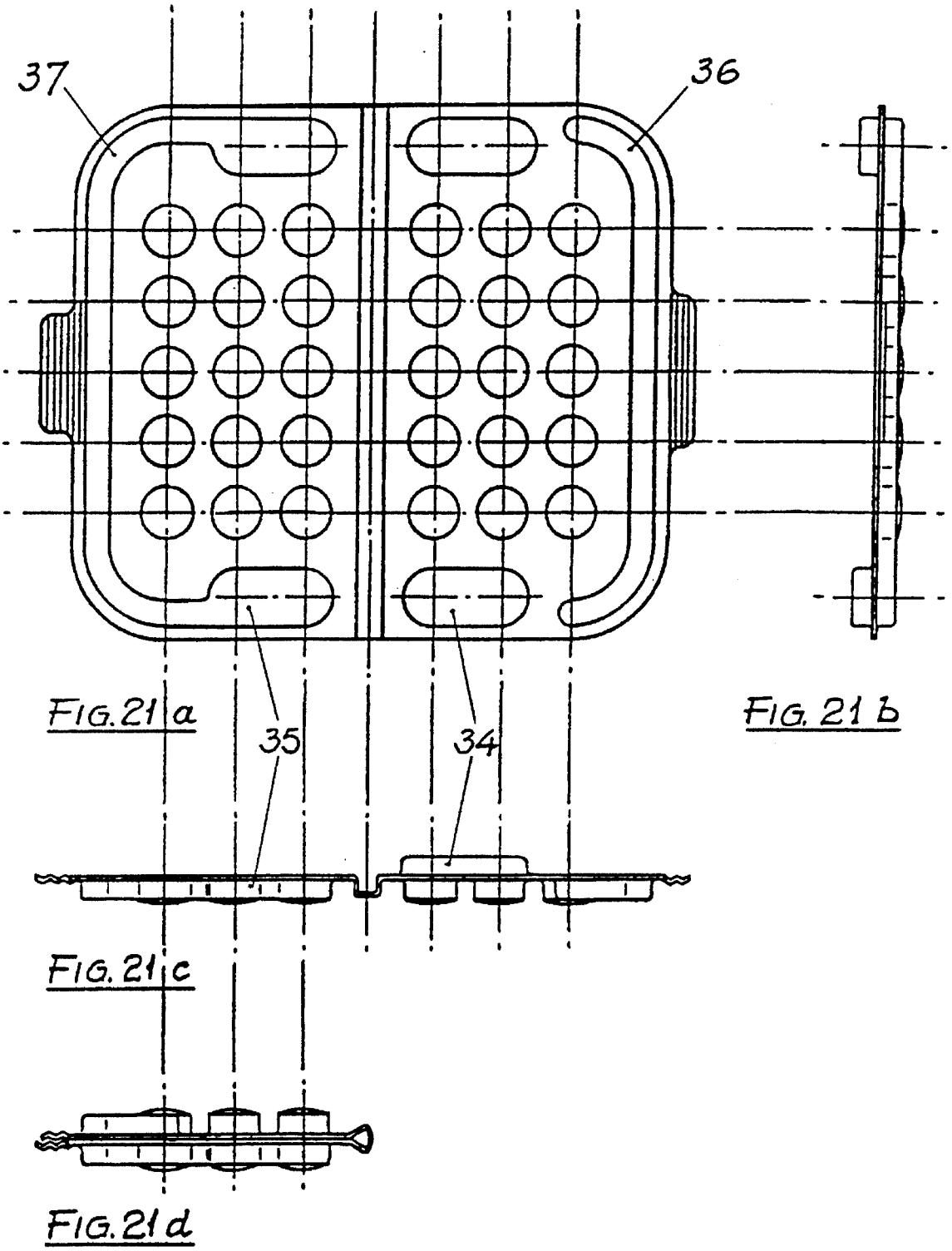

FIG. 21*a* is a plan view of a blister card with a thermoformed hinge, two key and groove fastening means, one pair of opening tabs and stiffening ribs along the straight edges and rounded corners.

FIG. 21*b* is an end elevational view of the blister card of FIG. 21*a*.

FIG. 21*c* is a side elevational view of the blister card of FIG. 21*a* before being folded.

FIG. 21*d* is a side elevational view of the blister card of FIG. 21*a* after being folded.

FIG. 22 is a cross-sectional View through a thermoformed hinge where the hinge groove depth equals R, before folding.

FIG. 23 is a cross-sectional view through the hinge of FIG. 22, after folding.

FIG. 24 is a cross-sectional view through a thermoformed hinge where the hinge groove depth equals R+H, before folding.

FIG. 25 is a cross-sectional view through the hinge of FIG. 24 after folding.

FIG. 26 is a cross-sectional view through a hinge similar to hinge of FIG. 24, but incorporating cuts on either side of the thermoformed groove, before folding.

FIG. 27 is a cross-sectional view through the hinge of FIG. 26 after folding.

FIG. 28 is a plan view of the hinge of FIG. 26.

FIG. 29 is a cross-sectional view through a thermoformed hinge where the hinge groove depth equals R+T before folding.

FIG. 30 is a cross-sectional view through the hinge of FIG. 29, after folding.

The blister card 1 shown in FIGS. 1, 2, 3 and 4 comprises a sheet of flexible plastic material with a plurality of thermoformed blisters or pockets 2, suitably shaped to receive either round tablets and pills or elongate capsules of medication 3. The tablets, pills or capsules are placed into these pockets and then covered with the aluminium foil 4 which is heat-sealed to the plastic sheet, in order to hermetically seal the medication inside the pockets.

Figure 4:
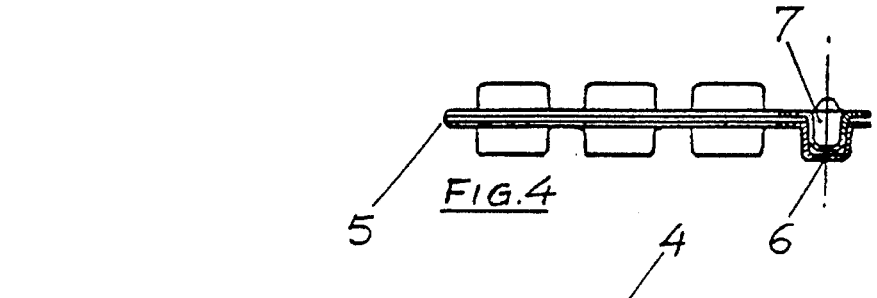
FIG. 4 is a part cross-sectional view and part side elevational view of the blister card of FIG. 1 after being folded.
Figure 2:
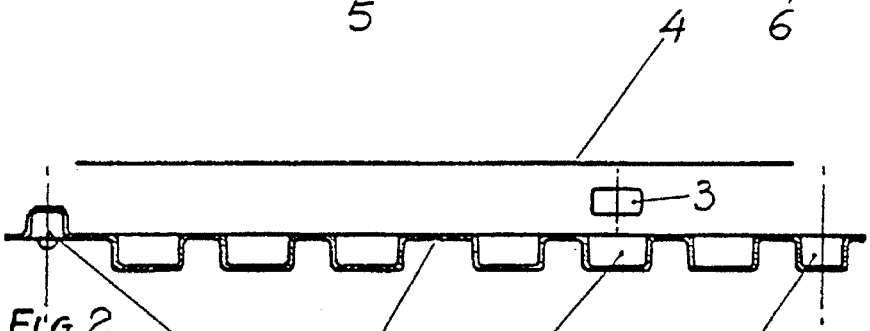
FIG. 2 is a cross-sectional view of the blister card and aluminium foil of FIG. 1 before being folded.
Figures 1, 3:
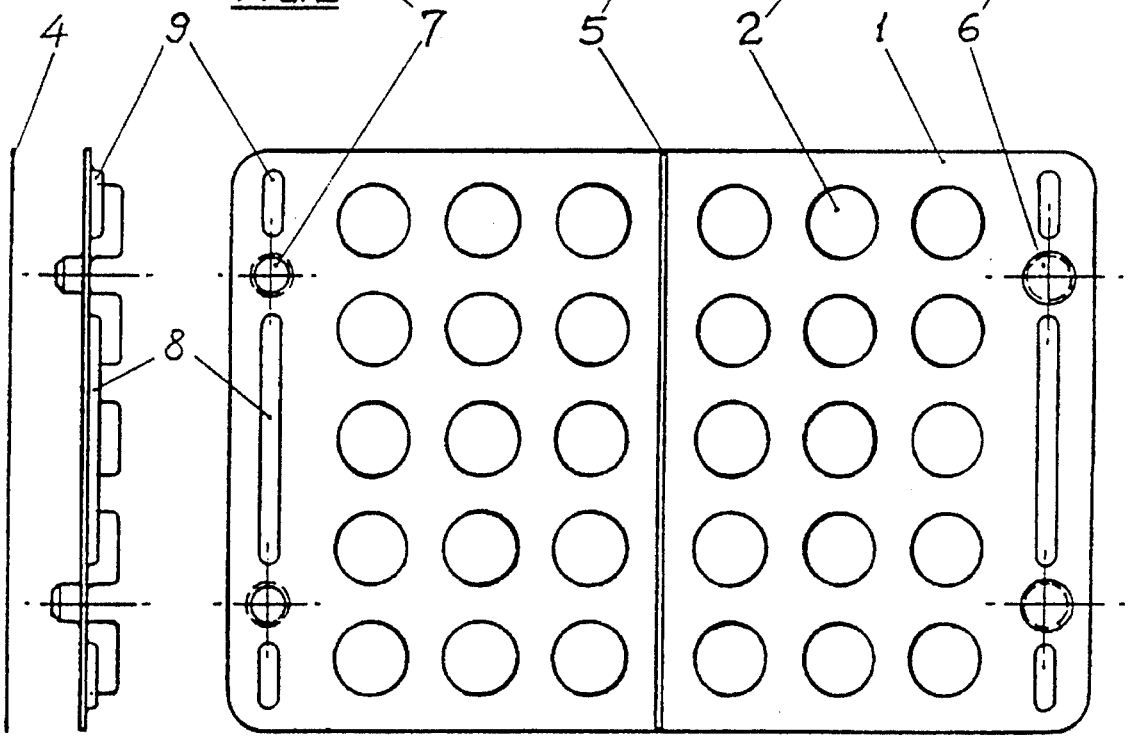
FIG. 1 is a plan view of a blister card with one creased or perforated hinge line and with two pairs of press studs.
FIG. 3 is an end elevational view of the blister card and aluminium foil of FIG. 1.

The creased or perforated hinge line 5 divides the blister card into two equal halves and enables the blister card to be folded, as shown in FIG. 4, with the two pairs of press studs 6 or 7 engaging and thereby securing the blister card in its folded state. When the blister card is folded, the frangible aluminium foil is protected against any accidental puncturing by other objects.

Ribs 8 and 9 along the edges of the blister card can be thermoformed into the plastic sheet in order to give the blister card some additional stiffness and flatness.

Figure 8:
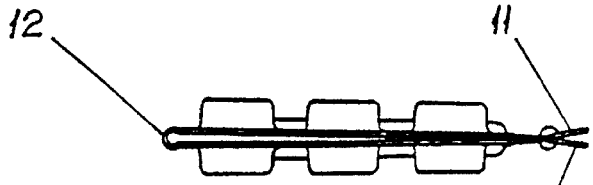
FIG. 8 is a side elevational view of the blister card of FIG. 5 after being folded.
Figure 6:
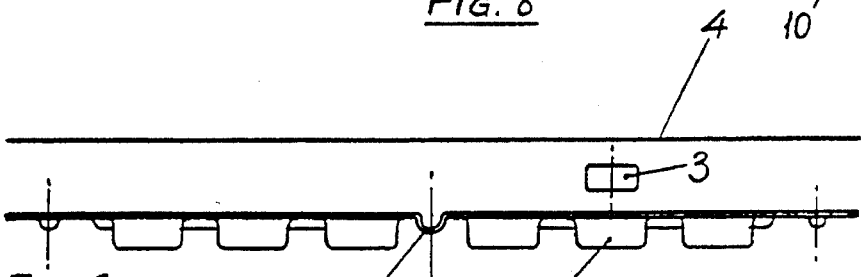
FIG. 6 is a side elevational view of the blister card and aluminium foil of FIG. 5 before being folded.

FIGS. 5, 6, 7 and 8 show another preferred form of the invention where instead of the above mentioned press studs there are a pair of inter-locking cuts 10 and 11 in the edges of the blister card parallel to the hinge line 12. The distance between the two cuts 10 is somewhat greater than the distance between the two cuts 11, so that when the blister card is folded and the edge between cuts 10 is pressed against the edge between cuts 11, the pliable edges will deform and inter-lock, thereby securing the blister card in its folded state, as shown in FIG. 8.

Figures 5, 7:
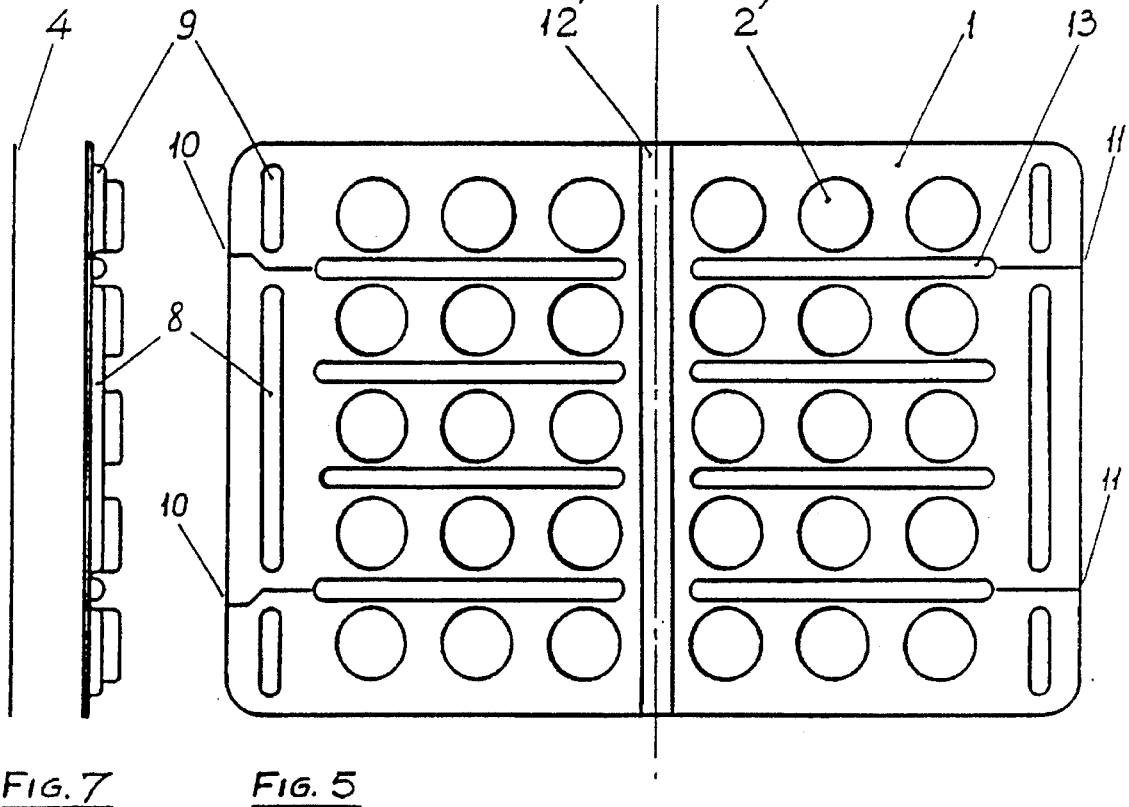
FIG. 5 is a plan view of a blister card with a thermoformed hinge and two pairs of inter-locking cuts.
FIG. 7 is an end elevational view of the blister card and aluminium foil of FIG. 5, not showing the thermoformed hinge.

The hinge 12 shown in FIG. 5 is thermoformed into a slightly thinned out U-shape to facilitate the folding action.

One or more ribs 13 at right angles to the hinge line can be thermoformed into the plastic sheet in order to keep the blister card flatter before and after folding.

Figure 9:
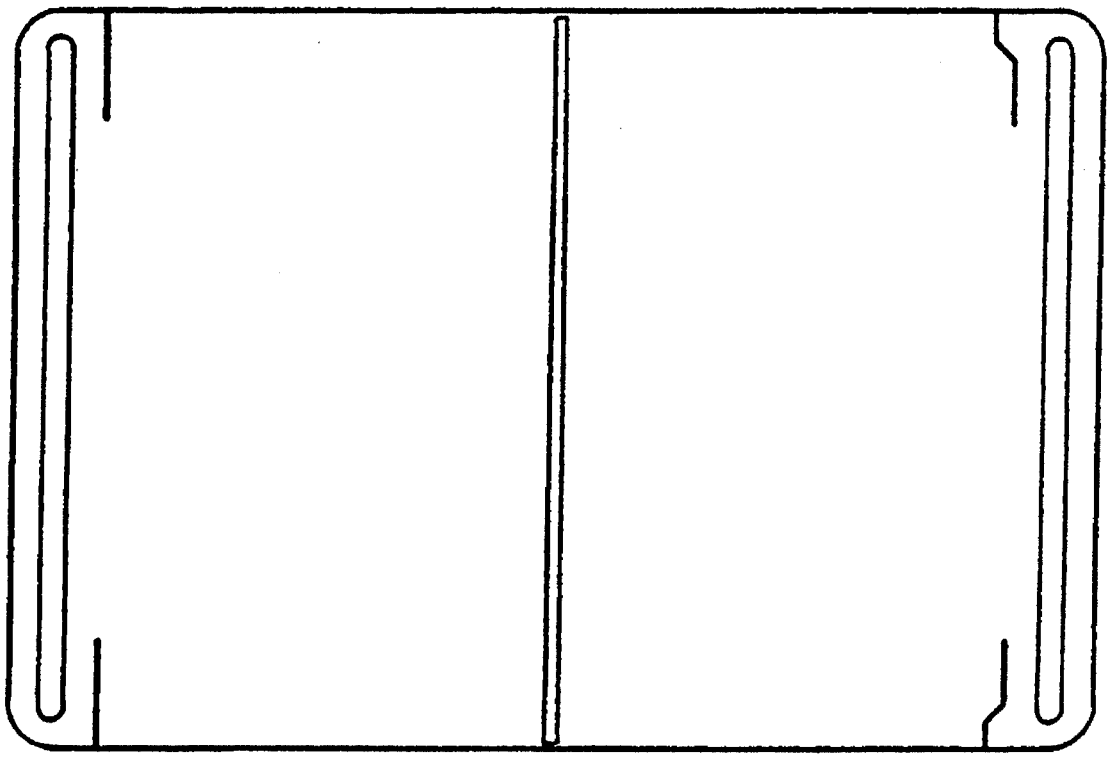
FIG. 9 is a plan view of a blister card with one hinge line and two pairs of alternative inter-locking cuts. Blister pockets are not shown.
Figure 10:
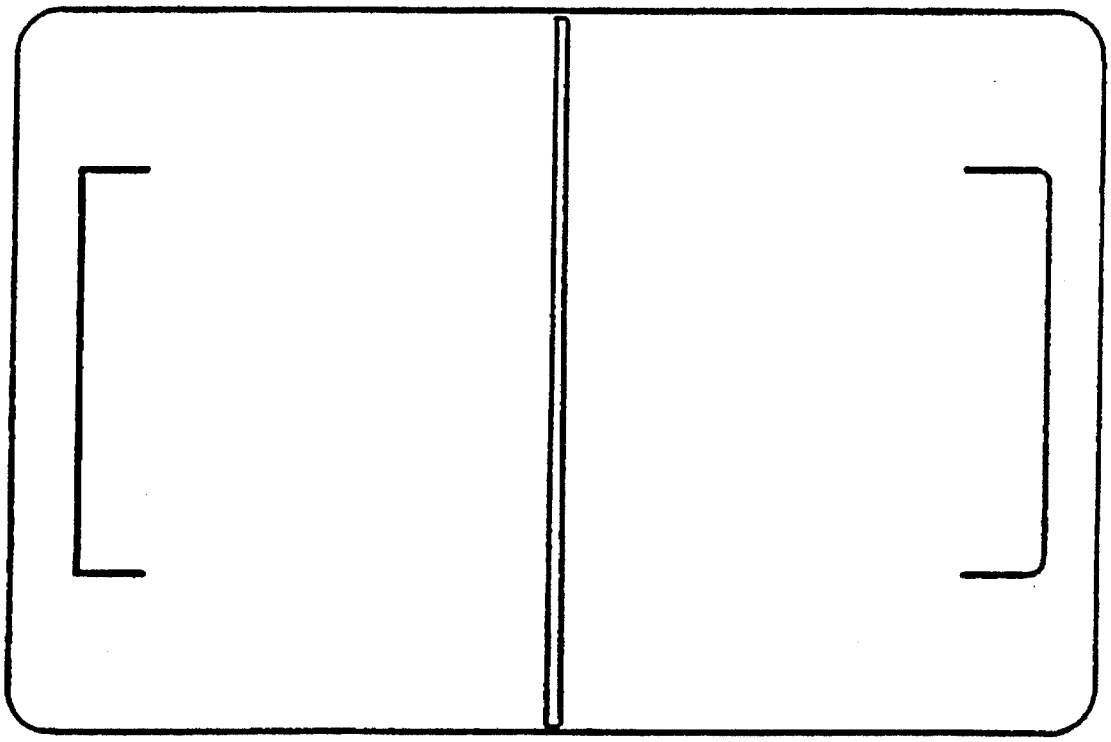
FIG. 10 is a plan view of a blister card with one hinge line and one pair of alternative inter-locking cuts. Blister pockets are not shown.
Figure 14:
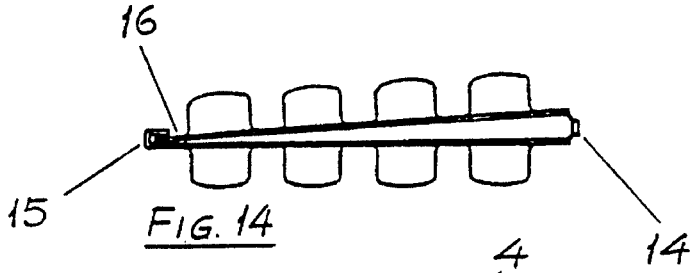
FIG. 14 is a side elevational view of the blister card of FIG. 11 after being folded.
Figure 12:
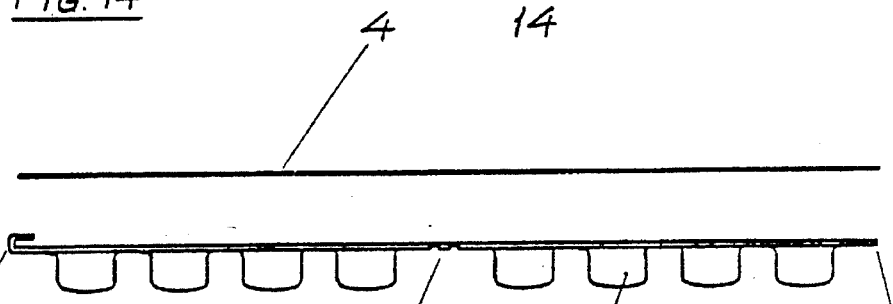
FIG. 12 is a side elevational view of the blister card and aluminium foil of FIG. 11 before being folded.
Figure 13:
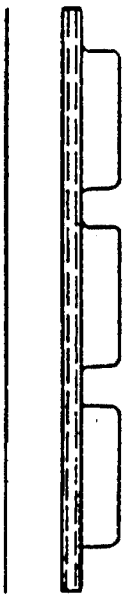
FIG. 13 is an end elevational view of the blister card and aluminium foil of FIG. 11.
Figure 11:
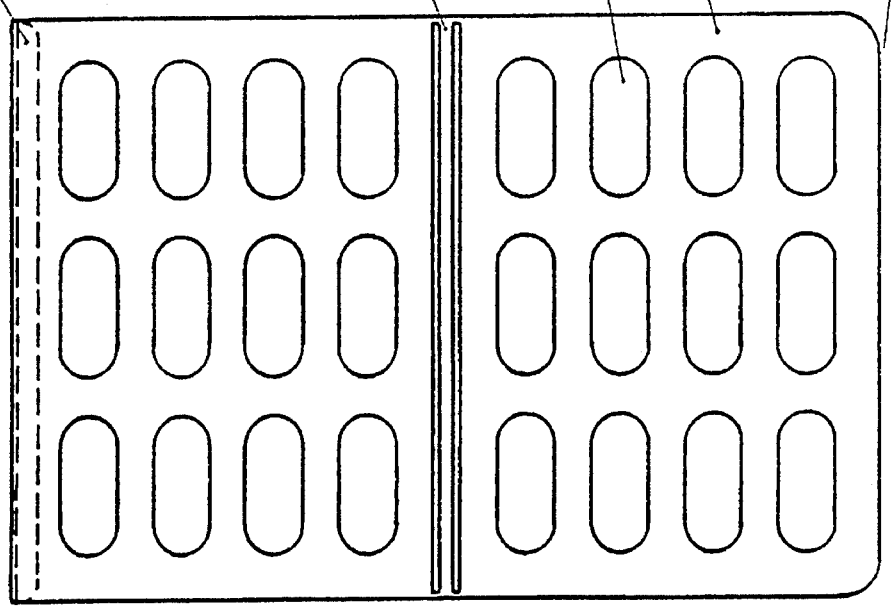
FIG. 11 is a plan view of a blister card with two hinge lines and inter-locking edges.
Figure 15:
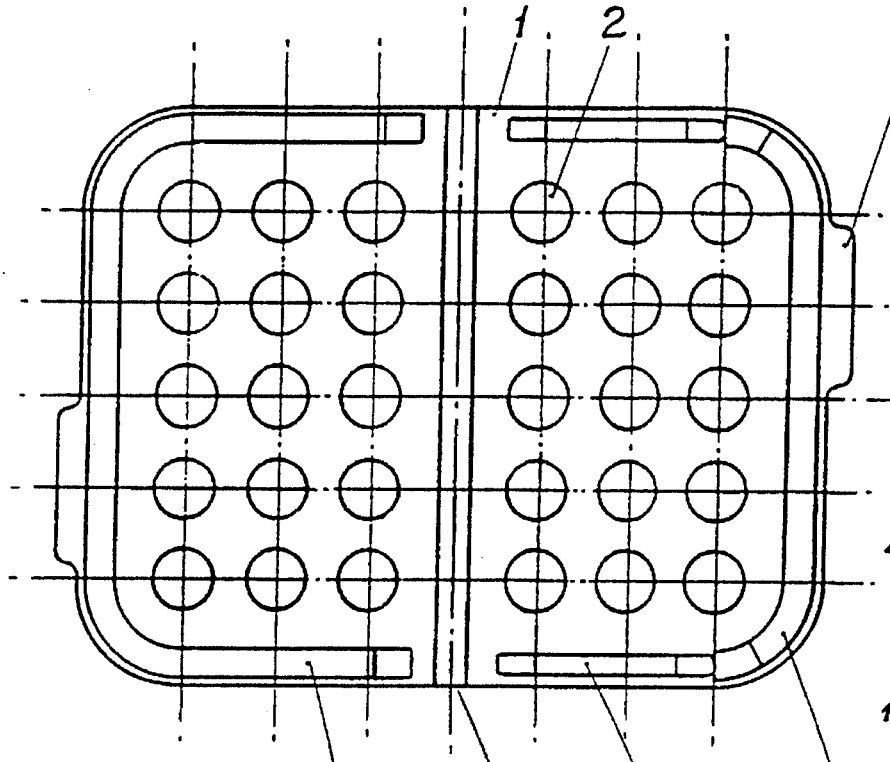
FIG. 15 is a plan view of a blister card with a thermoformed hinge and key and groove fastening means.
Figure 17:
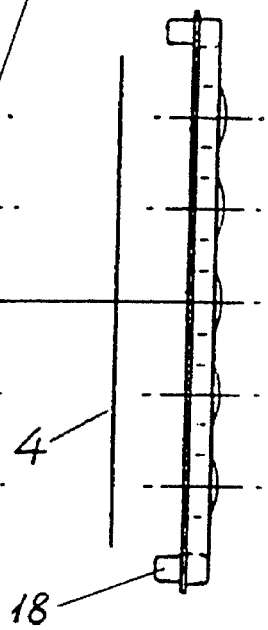
FIG. 17 is an end elevational view of the blister card and aluminium foil of FIG. 15.
Figure 16:
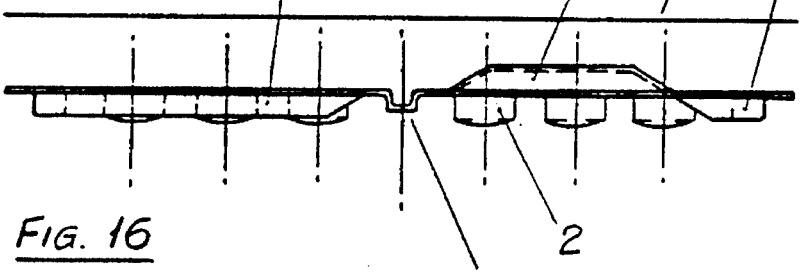
FIG. 16 is a side elevational view of the blister card and aluminum foil of FIG. 15 before being folded.
Figure 18:
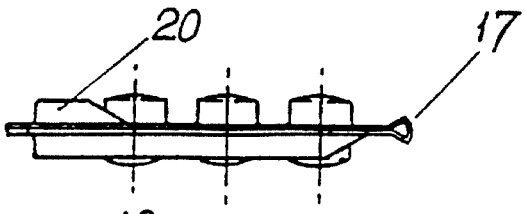
FIG. 18 is a side elevational view of the blister card of FIG. 15 after being folded.

FIGS. 9 and 10 show two further examples of similar inter-locking cuts. There exist many different shapes of inter-locking cuts that will perform the same basic function of fastening the folded blister card.

FIGS. 11, 12, 13 and 14 show a blister card with two creased hinge lines 14. One of the card's edges parallel to the hinge lines is formed into a channel 15, so as to receive the plain edge 16 and secure it inside this channel when the blister card is folded. Multiple creased or thermoformed hinge lines assist the hinging action and also allow for some longitudinal movement between the two halves of the blister card when the abovementioned plain edge 16 is inserted into and withdrawn from the channel shaped edge 15.

FIGS. 15, 16, 17 and 18 show another preferred form of the invention. The channel shaped hinge 17 is thermoformed and has thinned out walls to facilitate the folding action. A continuous groove 19 is formed along the three edges of one half of the blister card. Two keys 18, formed in the other half of the blister card, engage groove 19 with a light friction fit when the blister card is folded. Grooves 19 and 20 and keys 18 give the two halves of the blister card added stiffness and flatness. Tabs 21 facilitate opening of the folded card.

FIGS. 19*a*, 19*b*, 19*c* and 19*d* show another preferred form of the invention. In order to secure the folded blister card, the two thermoformed keys 22 in one half of the blister card press into the two thermoformed grooves 23 in the other half of the blister card. When opening the folded blister card, it is necessary to overcome the frictional resistance of the engaged keys 22 and grooves 23. The two pairs of tabs 24 and 25 are located close to the keys 22 and grooves 23 in order to help overcome said frictional resistance with minimum distortion caused to the rest of the blister card. The ribs formed into the tabs 24 and 25 improve the finger gripping action of the tabs. Ribs 26 and 27 along the edges of the blister card are thermoformed into the plastic sheet in order to give the blister card additional stiffness and flatness. The blister card has four rows of blisters for tablets, each row holding seven tablets, one tablet intended for each day of the week. The days of the week are printed adjacent to the corresponding blisters on the aluminium foil that seals the blister card.

FIGS. 20*a*, 20*b*, 20*c*, 20*d* and 20*e* show another preferred form of the invention. One half of the blister card incorporates a tongue 28 which engages the cut-out 29 in the other half of the blister card in order to secure the blister card in its folded state. Ribs 30 formed along the edges of the blister card give it additional stiffness and flatness. FIG. 20*c* shows a double creased hinge 31 and alternative single creased hinge 32. FIG. 20*d* shows a thermoformed hinge 33.

FIGS. 21*a*, 21*b*, 21*c* and 21*d* show another preferred form of the invention. The two thermoformed keys 34 in one half of the blister card press into the two thermoformed grooves 35 in the other half of the blister card. The thermoformed ribs 36 and 37 along the straight edges and rounded corners provide additional stiffness and flatness to the blister card.

The basic function of folding the individual blister card and fastening it in its folded state, in order to protect the frangible aluminium foil against damage, in all these preferred forms of the invention, is identical.

It may be necessary for the end-user to open and close the blister pack many times. Therefore the hinge must be durable and, at the same time, it must not be too stiff, so as not to distort the blister pack during folding.

The following methods can be used for the blister pack hinge construction:

thermoforming a groove or grooves, perforating or cutting, creasing.

Thermoformed groove hinges can be formed into any plastic sheet, whatever the plastic polymer, e.g. polyvinyl chloride (PVC), polypropylene (PP), polystyrene (PS), acrylonitrile butadiene styrene (ABS), polyethylene terephthalate (PET) etc. or any co-extruded combination of layers of these polymers. However, unless the blister pack itself is very rigid as a result of a deep blister or blisters and/or stiffening ribs, these thermoformed groove hinges could be much too stiff and cause unacceptable distortion of the blister pack when it is folded through 180°.

Perforations are not suitable for all plastic polymers. E.g. if the blister pack is thermoformed from a relatively brittle material, such as PS, ABS or PVC, then a perforated hinge will break after only a few closing and opening actions.

Creased hinges are also only suitable for ductile polymers with long molecular chains, such as polypropylene or polyethylene.

The geometry and function of a thermoformed hinge are explained below:

The hinge groove 101 in FIG. 22 has a depth that equals the radius R of the groove profile, before folding. The same hinge 102 in FIG. 23, after folding through 180°, has reduced the radius of the groove profile from R to ½R, as a result of the folding. Provided the two sides of this blister pack are rigid enough, as a result of deep blisters 103 and/or stiffening ribs, the folded blister pack will not be distorted and the two folded sides 104 will be parallel and will make contact along their full length, with no gap between them. However, if the two sides of the blister pack cannot be made rigid enough, due to the shallow configuration of the packaged product, then this hinge will be much too rigid and the blister pack will distort during and after folding.

In order to weaken the hinge's resistance to folding, the depth of the hinge groove 105 can be increased from R to R+H, as shown in FIG. 24. The hinge resistance to folding is weakened primarily because the plastic sheet is thinned out further in the deeper groove during thermoforming. However, as a result of the geometrical change in groove profile, when this blister pack is being folded, the corners 106 will touch before the 180° folding angle is being completed and before the two folded sides 107 have become parallel. When attempting to fold the blister pack by force beyond this touching point the blister pack will distort.

It is desirable to weaken the resistance to folding of the thermoformed groove hinge in order to prevent distortion of the folded blister pack and, at the same time, allow the two folded sides to be parallel and to make contact along their full length, substantially without gaps.

This is achieved by the incorporation of cuts 108, parallel and adjacent to the hinge groove 109, on either side of the groove, as shown in FIG. 26 and FIG. 28. These cuts weaken the hinge's resistance to folding and, at the same time, prevent the premature contact of the corners 106 at a folding angle less than 180°, as was shown in FIG. 25. The two folded sides 110 will be parallel and will make contact along their full length, substantially with no gap between them as shown in FIG. 27.

Should, however, the combined lengths of these cuts 108, L=L1+L2+L3, be too great, thereby weakening the hinge's resistance to folding by too much, then the contact of the two sides 111 of the folded blister pack will be delayed past the 180° and the blister pack will develop a gap 112, as shown in FIG. 30 and the two folded sides 111 will, once again, not be parallel and will not make contact along their full length.

Increasing the combined lengths of cuts L and/or increasing the depth of the hinge groove will weaken the hinge's resistance to folding and vice versa.

Increasing the combined lengths of cuts L and/or reducing the depth of the hinge groove, as shown in FIG. 29, where R+T<R+H, will delay the contact of the two sides of the blister pack beyond the folding angle of 180° and they will not be parallel and will not make contact along their full length, as shown in FIG. 30.

Consequently, by correctly balancing the increased hinge groove depth with the combined lengths of cuts L, the hinge will not be too stiff and therefore will not distort the blister pack and, at the same time, the two sides of the blister pack will fold to 180° and be parallel and make contact along their full length.

To achieve the above mentioned balance, the type of plastic polymer and the sheet thickness must be taken into consideration. E.g. for 0,37 mm thick PVC sheet, groove radius R=2,75 mm, groove depth R+H=4 mm and a hinge length of 82 mm, the combined cut lengths L=22 mm, or L=27 mm per 100 mm of hinge length.

The individual cut lengths L1, L2, . . . Ln do not have to be equal. They can be varied in length to suit the size and location of the blisters on the blister pack, as shown in FIG. 28, so as to improve flatness of the folded blister pack in its direction of length and width.

Any one of the various forms of hinge may be used in conjunction with any one of the forms of fastening means described above.

I claim:

1. A blister pack for tablets or capsules, substantially impervious to humidity and oxygen, comprising a flexible plastic sheet thermoformed for defining a plurality of open faced pockets each pocket for receiving an individual tablet or capsule, and a sheet of aluminum foil heat sealed to the plastic sheet for closing the pockets, characterized in that hinge means are provided across the pack on a line about which the pack is substantially symmetrical to form first and second halves for enabling unfolding and folding of the pack for repeated opening and closing of the pack to permit removal of individual tablets or capsules in succession, wherein the hinge means comprises means for folding the first and second halves between an open configuration in which the aluminum foil is exposed such that a tablet or capsule can be removed from the pack and a closed configuration in which the area of aluminum foil of each of said halves overlies the other such that the aluminum foil is protected from accidental damage that might be caused by contact with a hard object, whereby removal of a tablet or capsule is possible only when the halves of the pack are in the open configuration, the pack having resealable fastening means for maintaining the pack in the closed configuration and for permitting the pack to be opened, the hinge means comprising a hinge groove formed by thermoforming and having one or more cuts extending parallel and directly adjacent to the groove and on either side thereof, and the hinge groove having a depth and the cuts having lengths for cooperating to enable the first and second halves to each fold through 90° relative to each other and lie flat against and in contact with each other.

2. A blister pack as claimed in claim 1 wherein the resealable fastening means comprises protrusions from the first half of the sheet for frictionally engaging within cavities formed in the second half.

3. A blister pack as claimed in claim 1 wherein a plurality of keys are thermoformed in the first half of the pack and a plurality of complementary grooves are thermoformed in the second half of the pack, the keys being positioned for engaging the grooves for maintaining the pack in the closed configuration.

4. A blister pack as claimed in claim 3 wherein ribbed tabs are formed in the halves of the pack adjacent said keys and grooves for manual gripping by a user opening the pack.

5. A blister pack as claimed in claim 3 wherein ribs are thermoformed along edges of the pack to provide additional stiffness and flatness to the pack.

6. A blister pack as claimed in claim 1 wherein said resealable fastening means comprises cuts formed in the pack, the edges of which interlock when the pack is folded for maintaining the pack in a folded condition.

7. A blister pack as claimed in claim 4 wherein ribs are thermoformed along edges of the pack to provide additional stiffness and flatness to the pack.

* * * * *